United States Patent [19]

O'Connor

[11] 4,400,143

[45] Aug. 23, 1983

[54] DUAL DRIVE PUMP

[75] Inventor: Terence A. O'Connor, Elyria, Ohio

[73] Assignee: Teledyne Republic Manufacturing, Cleveland, Ohio

[21] Appl. No.: 258,477

[22] Filed: Apr. 28, 1981

[51] Int. Cl.[3] ..... F04B 35/00

[52] U.S. Cl. ..... 417/374; 417/534

[58] Field of Search ..... 417/374, 534

[56] References Cited

U.S. PATENT DOCUMENTS

| | | | |
|---|---|---|---|
| Re. 23,067 | 12/1948 | Baker . | |
| 854,353 | 5/1907 | Hobart . | |
| 1,289,064 | 12/1918 | Culp . | |
| 1,303,975 | 5/1919 | Shorb . | |
| 2,292,527 | 8/1942 | Kraft | 417/374 |
| 2,668,656 | 2/1954 | Booth, Jr. et al. | 417/534 X |

*Primary Examiner*—Carlton R. Croyle

*Assistant Examiner*—Donald E. Stout

*Attorney, Agent, or Firm*—Pearne, Gordon, Sessions, McCoy, Granger & Tilberry

[57] ABSTRACT

A dual drive pump is disclosed in which the differential area, double-acting piston and cylinder pump can be operated from a rotary power source or manually operated by pivotal movement of a lever. The manual operation lever is pivoted to the cylinder housing. A Scotch yoke cam drive is provided with a rotary shaft journaled on the manual lever. A Scotch yoke housing is connected to the piston and encloses a cam on the rotary shaft. A lock pin is installable in two different locations. When manual operation is required, the lock pins locks the shaft against rotation with respect to the lever. For power operation, the lock pins locks the lever in a fixed position so that the shaft is in turn held in a fixed location.

7 Claims, 7 Drawing Figures

DUAL DRIVE PUMP

BACKGROUND OF THE INVENTION

This invention relates generally to pump drive systems, and more particularly to a novel and improved dual drive pump system in which a single pump may be selectively operated from a power source or may be manually operated.

The present invention is embodied in a dual drive pump particularly suited for charging accumulators used to supply power for starting aircraft engines or the like. As described in my copending U.S. patent application, Ser. No. 243,491, filed Mar. 13, 1981 (assigned to the assignee of the present invention), aircraft are often provided with accumulators which are pressurized to provide the power to start the aircraft engines. Such accumulators are normally pressurized prior to shutting the engine down so that they are charged and available for restarting the engine at a later time.

If for some reason the accumulator loses its pressurized charge, means must be provided to repressurize the accumulator before an engine start can be accomplished. The loss of charge can be caused for any number of reasons, for example, due to maintenance or attempted but unsuccessful engine starts.

In the event that the aircraft is at a remote location where suitable ground equipment is not available for repressurizing the accumulator, it is necessary to provide some means for on-site recharging of the accumulator. At many remote locations, where standard ground support equipment is not available, pneumatic or other types of power tools, such as rotary pneumatic tools or electric tools, are often available which can supply enough power to operate the pump and thereby eliminate the need for manual recharging. In other instances where no such power tools or the like are available to power the pump, it is necessary to provide a system in which the pump can be manually operated. It is therefore desirable to provide a dual drive pump system which can be operated by rotary power tools or the like that are often available even at remote sites or, as an alternative, a pump which can be operated manually so as to recharge such engine starting accumulator.

PRIOR ART

A number of patents disclose pumping systems which may be operated either manually or by power. Examples of such prior patents include U.S. Pat. Nos. 854,353; 1,289,064; 1,303,975; 2,292,527; and U.S. Pat. No. Re. 23,067. Such patents disclose various dual drive pump systems in which a given pump may be operated either manually or by power. Such systems, however, do not provide a compact and efficient structural relationship suitable for producing the high pressure conditions required for recharging aircraft engine starting accumulators or the like.

SUMMARY OF THE INVENTION

In accordance with the present invention, a novel and improved dual drive pump system is provided in which a single pump can be operated from a rotary power source or can be operated manually by pivotal movement of a pivoted lever.

In the illustrated embodiment, a double-acting piston and cylinder pump is provided with a power drive including a rotating shaft having a cam thereon which is connected through a Scotch yoke to reciprocate the piston in response to rotation of the shaft. A manual drive includes a lever pivoted on the cylinder and connected to cause reciprocation of the power drive, and in turn reciprocation of the piston, when the lever is manually pivoted back and forth. In the illustrated embodiment, the lever is connected to the rotary shaft and means are provided to lock the rotary shaft when manual operation of the pump is required. Conversely, when power operation of the pump is required through rotation of the shaft, the lever is locked against pivotal movement.

With this invention, a very compact, lightweight, dual drive pumping system is provided which is suitable for mounting on an aircraft for recharging the accumulator used to start an aircraft engine or the like.

These and other aspects of this invention are more fully illustrated in the drawings, and are more fully described in the following specification.

DETAILED DESCRIPTION OF THE DRAWINGS

Figure 1:
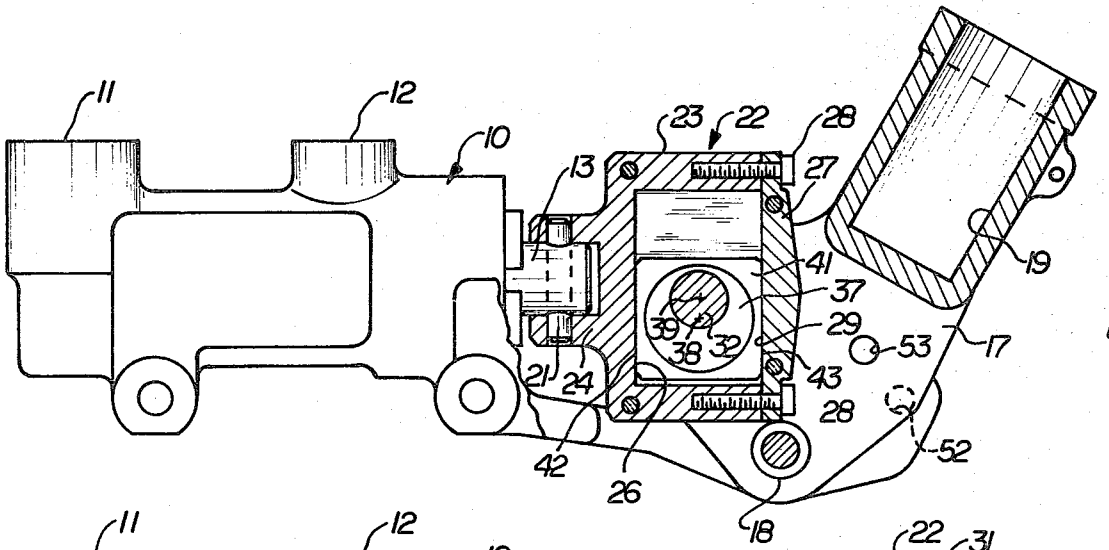
FIG. 1 is a side elevation, partially in section, illustrating a dual drive pump in accordance with the present invention, illustrating the structural detail of the Scotch yoke-type power drive, and also illustrating the pump at one end of its stroke.

The illustrated embodiment of this invention is particularly suited to provide for the recharging of an engine starting accumulator in a military aircraft or the like. Such device may be mounted in any suitable location on the aircraft in an accessible position, e.g., the pump may be mounted in the nose gear wheel well.

The illustrated dual drive pump includes a housing 10 having an inlet port 11 and an outlet port 12. Projecting into a bore formed in the housing is a piston 13, which reciprocates back and forth to provide the pumping action between the two extreme positions illustrated in FIGS. 1 and 2. Preferably, the structure of the housing 10 and piston 13 is arranged to provide a differential area double-acting pump in which fluid under pressure is delivered to the outlet port on both strokes of the pump. Reference should be made to my copending application Ser. No. 243,491, supra, which contains, in FIG. 3 of the drawings, an illustration of such a pump and contains in the related part of the specification a detailed description of such a pump. Said copending application is incorporated herein by reference in its entirety to describe the general background of this invention, and in particular to illustrate one preferred structure of a differential area, double-acting pump provided within the housing 10.

The housing 10 is provided with an integral yoke structure providing spaced and substantially parallel arms 14 and 16 which support the pump drive mechanism. Such drive mechanism includes a lever 17 pivotally supported on the arms 14 by a pivot pin 18 for reciprocating oscillation with respect to the housing 10. Such lever 17 is provided with a socket 19 (best illustrated in FIG. 1) into which a suitable handle (not illustrated) is inserted so that the lever can be manually oscillated back and forth when manual pumping is required.

Figure 6:
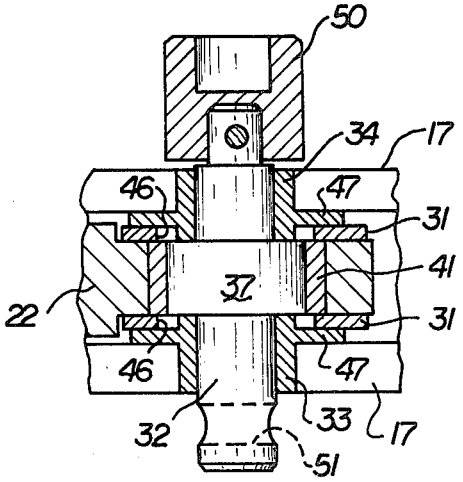
FIG. 6 is a fragmentary section taken along line 6—6 of FIG. 4, illustrating the structural detail of the power drive.
Figure 7:
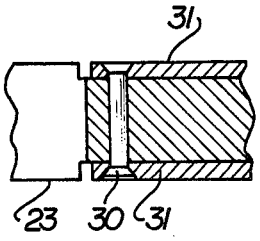
FIG. 7 is a fragmentary section taken along line 7—7 of FIG. 5, illustrating the mounting for the side plates on the Scotch yoke drive.

Mounted on the end of the piston 31 by a cross pin 21 is a Scotch yoke drive assembly 22. Such assembly includes a base member 23 formed with a mounting portion 24 which receives the end of the piston 13 and is secured thereto by a cross pin 21. The base member also provides the forward wall 26 of the Scotch yoke. An end plate 27 secured to the base member 23 by bolts 28 provides the rearward wall 29 of the Scotch yoke, which is spaced from and parallel to the forward wall 26. As illustrated in FIGS. 6 and 7, a pair of side plates 31 are secured to opposite sides of the base member 23 and the end plate 27 by rivets 30 to complete the housing assembly of the Scotch yoke drive.

A camshaft 32 extends through the base member 23 and is journaled at its ends in bearings 33 and 34 (best illustrated in FIG. 6), which are in turn mounted on the lever 17 by bearing caps 36. With this structure, the camshaft 32 is journaled on the lever 17 for rotation with respect thereto.

An integral cam 37 is formed on the shaft 32, and is provided with a cylindrical peripheral surface having an axis at 38 spaced from the axis 39 of the shaft 32. A cam block 41 encloses the cam 37, and provides opposite faces 42 and 43, which respectively mate with the forward and rearward faces 26 and 29.

When the shaft 32 is held in a fixed location by the lever 17 and is rotated, the cam 37 and cam block 41 cooperate to produce reciprocating movement of the piston 13 through a stroke having a length equal to twice the eccentricity of the axis 38. During such rotation, the cam block 41 also moves vertically back and forth along the forward and rearward faces 26 and 29 of the Scotch yoke housing (as viewed in FIG. 1). With this Scotch yoke drive, substantial bearing area is provided between the cam 37 and the cam block 41, and also between the cam block 41 and the Scotch yoke housing, so that areas of high loading do not occur and so that wear is not a significant problem. Preferably, a lubricant such as a grease or a dry lubricant coating is provided on the Scotch yoke parts to minimize friction and wear.

The side plates 31 are formed with clearance openings 46 into which the inner ends of the bearings 33 and 34 project with clearance, to allow limited relative movement between the shaft 32 and the Scotch yoke housing during the pumping operation. The bearings 33 and 34 are provided with flanges 47 sized to engage the outer surfaces of the side plates 31 around the openings 46 in all positions of operation to prevent the entry of dirt or other contamination into the Scotch yoke drive mechanism.

Figure 2:
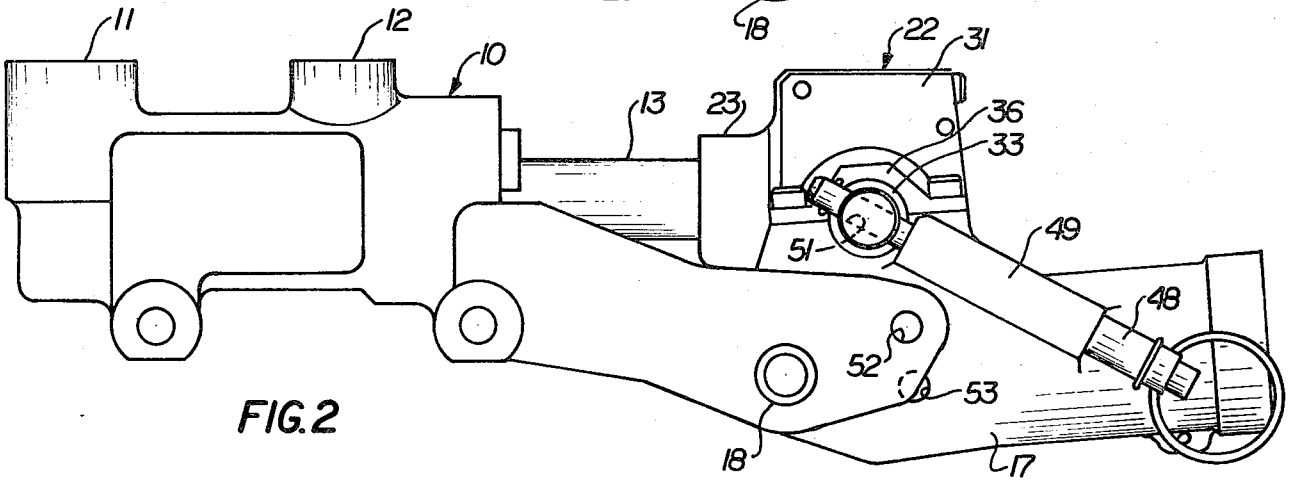
FIG. 2 is a side elevation similar to FIG. 1, illustrating the system for locking the power drive against rotation and also illustrating the pump at its extended position.

A lock pin 48 is selectively mountable in two different positions on the pump. In the position of FIG. 2, the lock pin 48 extends through a tubular boss 49 on the lever 17 and through a cross bore 51 at one end shaft 32 to lock the shaft against rotation with respect to the lever 17. This is the position of the lock pin 48 during manual operation of the pump.

Figure 3:
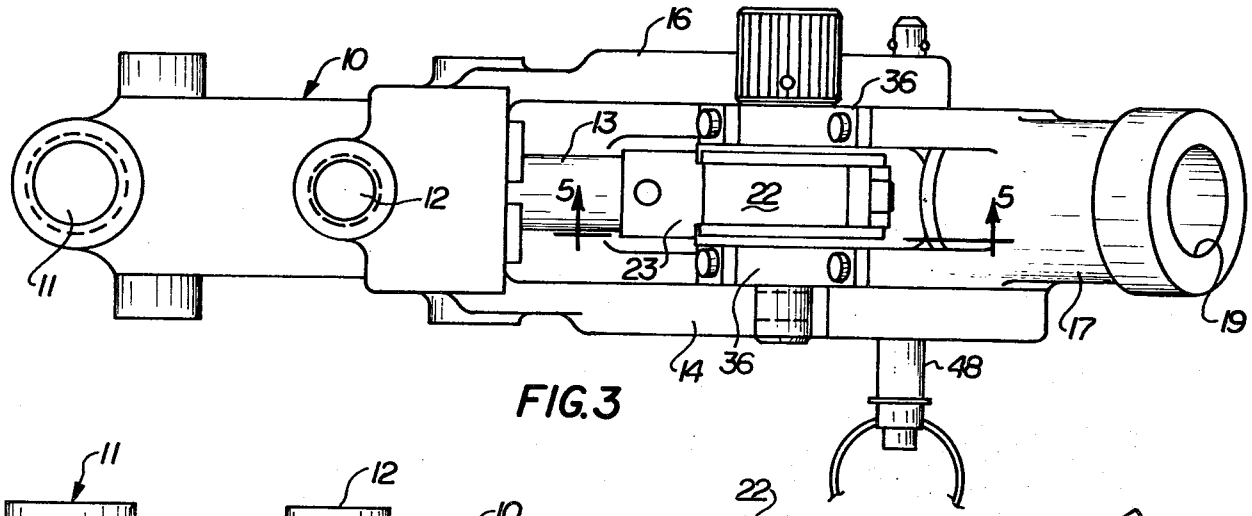
FIG. 3 is a plan view of the pump illustrating the system when the manual drive is locked against movement so that the pump can be operated through the power drive.
Figure 4:
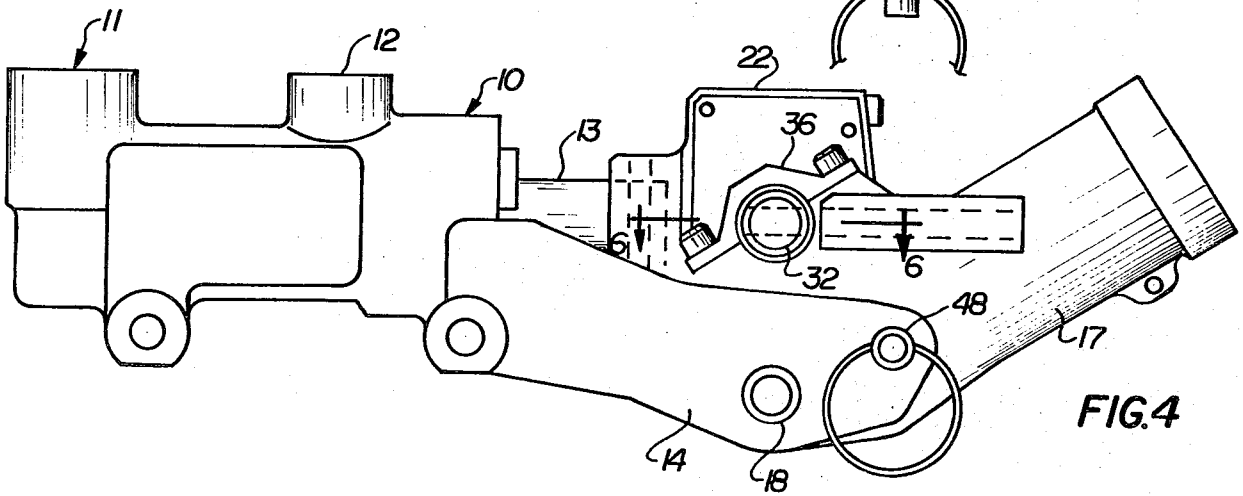
FIG. 4 is a side elevation of the pump in the power driving configuration.
Figure 5:
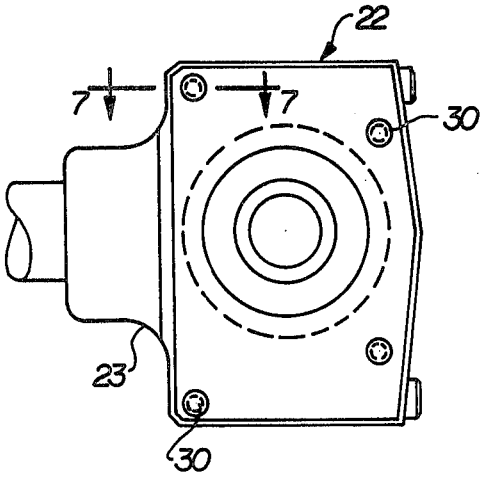
FIG. 5 is a fragmentary, side elevation of the Scotch yoke portion of the drive.

When the pump is to be operated by a rotary power source, the lock pin 48 is removed from the cross bore 51 and boss 49, and is reinstalled in the position illustrated in FIGS. 3 and 4, where it extends through a pair of aligned openings 52 formed in the two arms 14 and 16, and through a lateral opening 53 in the lever 17 (see FIGS. 1 and 2) to lock the lever 17 with respect to the housing 10 in a mid-position illustrated in FIG. 4. The arms 14 and 16 are sized so that the lateral opening 53 in the lever 17 is covered in all positions of the lever except in the mid-position in which it is aligned with the openings 52 in the arms. This prevents the insertion of the lock pin in all positions of the lever except the mid-position thereof to prevent accidental installation of the lock pin when the lever is not properly located in its mid-position. A socket 50 is mounted on the other end of the shaft 32 so that a power tool or the like can be coupled to drive the shaft.

When the pump is to be manually operated, the lock pin is installed in the position illustrated in FIG. 2, in which it locks the shaft 32 against rotation with respect to the lever 17. A handle (not illustrated) is then inserted on the socket and the lever is rocked back and forth between the positions of FIGS. 1 and 2 to cause the piston 13 to be reciprocated back and forth within the housing 10. Since the shaft 32 is locked against rotation with respect to the lever, the pivotal movement of the lever acting through the shaft, and in turn the cam 37 and cam block 41, provides a substantially locked mechanical drive, causing reciprocation of the piston in response to pivotal movement of the lever.

The shaft 32 rotates with respect to the Scotch yoke housing a limited amount, due to the pivotal movement of the lever 17 during such manual operation. However, such limited rotation of the shaft does not significantly change the stroke of the piston. Preferably, the cross bore 51 is oriented in the shaft 32 so that the cam 37 is in either its upper or its lower position when the lever 17 is in substantially its mid-position and the cross bore 51 is positioned to receive the lock pin 48. With such a structure, the pivotal movement of the lever 17 during the manual pumping operation is substantially symmetrical with respect to the lever's mid-position.

It is recognized that if the cam 37 is in its lowered position, as illustrated in FIG. 1, the full stroking of the piston requires a greater arc of pivotal movement of the lever 17 than is required when the pin is inserted with the cam in its upper position, but the difference in the arc of lever pivotal movement to obtain full stroking of the piston is not great. On the other hand, if the cam were to be located in either a forward or aft position when the lock pin 48 is installed, it will drastically affect the location of the arc through which the lever must be rotated during the pumping action.

When the pump is to be operated from a rotary power source, the lock pin 48 is removed from the boss 49 and installed through the openings 52 and 53 to lock the lever 17 in a mid-position, as illustrated in FIGS. 3 and 4. The locking of the lever, in turn, locks the position of the shaft 32, while permitting the shaft to rotate freely. In such condition, a power tool or the like is connected to the socket 50 mounted on the end of the shaft 32 opposite the cross bore 51 so that the shaft can be rotated from such power source. Since the position of the shaft with respect to the housing is determined by locking the lever 17, rotation of the shaft 32, and in turn the cam 37, causes the piston 13 to move back and forth within the housing 10 with a harmonic-type movement, to cause pumping of fluid into the inlet port 11 and out of the outlet port at increased pressure.

Preferably, the double-acting pump is structured so that substantially the same amount of fluid is displaced during each in and out stroke of the piston. With such an arrangement in combination with the harmonic type drive provided by the Scotch yoke, the torque required to drive the piston against the given pressure is the same on the inward stroke as on the outward stroke of the piston. In other words, at a given pressure output of the pump and a given speed, the torque vs. displacement curve will be symmetrical.

In accordance with this invention, a simple, reliable, and compact dual drive pump is provided which can be operated from a power source or manually, as required. Such pump is easily converted between power operation or manual operation by the simple expedient of properly positioning the lock pin for the particular mode of operation required.

Although the preferred embodiment of this invention has been shown and described, it should be understood that various modifications and rearrangements of parts may be resorted to without departing from the scope of the invention as disclosed and claimed herein.

What is claimed is:

1. A dual drive pump comprising a pump providing first and second members which are reciprocable relative to each other to pump fluid, a lever pivoted on said first member, a power drive including a shaft pivoted on said lever for rotation relative thereto and a reciprocation drive connected to said shaft and said second member, and lock means selectively operable in a first condition to lock said lever against movement relative to said first member while permitting rotation of said shaft relative to said lever and a second condition to permit pivotal movement of said lever relative to said first member while preventing relative rotation of said shaft relative to said lever, rotation of said shaft while said lock means is in said first condition operating to reciprocate said first member relative to said second member through said reciprocation drive, pivotal movement of said lever while said lock means is in said second condition operating to oscillate said shaft and cause reciprocation of said first member relative to said second member through said reciprocation drive.

2. A dual drive pump as set forth in claim 1, wherein said pump is a double-acting pump and delivers fluid under pressure when said members reciprocate in each direction.

3. A dual drive pump as set forth in claim 2, wherein said power drive includes a rotatable cam on said shaft connected to drive said members with substantially harmonic motion.

4. A dual drive pump as set forth in claim 1, wherein said lock means is a pin selectively mountable in two separate positions.

5. A dual drive pump as set forth in claim 1, wherein said lock means is operable to lock said lever in substantially a mid-position within its range of pivotal movement.

6. A dual drive pump as set forth in claim 5, wherein said lock means is operable to lock said power drive in substantially a mid-position.

7. A pump comprising a cylinder housing, a piston projecting into said housing reciprocable relative thereto to pump fluid, a lever pivoted in said housing, a Scotch yoke drive providing a camshaft journaled on said lever and providing a frame connected to said piston, lock means provided to lock said shaft relative to said lever when said lever is pivoted and to lock said lever relative to said housing when said shaft is rotated, said Scotch yoke drive being operable to reciprocate said piston in response to rotation of said shaft, pivotal movement of said lever operating to move said shaft and cause reciprocation of said piston.

* * * * *